US006901690B2

(12) United States Patent
Hanson

(10) Patent No.: US 6,901,690 B2
(45) Date of Patent: Jun. 7, 2005

(54) CHAMBER BLOCK FOR A HANDGUN OR OTHER WEAPON

(76) Inventor: Thomas W. Hanson, 3990 S. Cherokee St., Englewood, CO (US) 80110

( * ) Notice: Subject to any disclaimer, the term of this patent is extended or adjusted under 35 U.S.C. 154(b) by 0 days.

(21) Appl. No.: 10/173,910

(22) Filed: Jun. 17, 2002

(65) Prior Publication Data

US 2002/0189148 A1 Dec. 19, 2002

Related U.S. Application Data

(60) Provisional application No. 60/299,146, filed on Jun. 18, 2001.

(51) Int. Cl.[7] ..... F41A 17/44
(52) U.S. Cl. ..... 42/70.11
(58) Field of Search ..... 42/70.01, 70.11

(56) References Cited

U.S. PATENT DOCUMENTS 5,241,770 A * 9/1993 Lambert ..... 42/96
5,289,653 A * 3/1994 Szebani et al. ..... 42/70.11
5,450,685 A * 9/1995 Peterson ..... 42/70.11
6,374,527 B1 * 4/2002 Finardi ..... 42/70.11

FOREIGN PATENT DOCUMENTS

WO WO 86/00396 * 1/1986 ..... 42/70.11

* cited by examiner

*Primary Examiner*—Stephen M. Johnson
(74) *Attorney, Agent, or Firm*—Thomas W. Hanson

(57) ABSTRACT

A two-part chamber block for a handgun which does not interfere with the inspection, operation or field stripping of the weapon other than access to the chamber and barrel. In a first embodiment, two lengthwise segments can be offset, inserted into the barrel and then aligned and retained by a cable tie or similar to prevent their removal. In a second embodiment a cable tie, or similar, connects a chamber portion and a barrel end portion to effectively block the chamber and barrel. A third embodiment uses segments inserted from opposite ends of the barrel with opposing teeth which interlock to retained the segments. Optional locking collars, latches, and configurations increase the adaptability of the chamber block.

8 Claims, 13 Drawing Sheets

CHAMBER BLOCK FOR A HANDGUN OR OTHER WEAPON

CROSS-REFERENCE TO RELATED APPLICATIONS

This application claims the benefit of U.S. Provisional Application No. 60/299,146 filed Jun. 18, 2001.

STATEMENT REGARDING FEDERALLY SPONSORED RESEARCH OR DEVELOPMENT

Not Applicable

BACKGROUND OF THE INVENTION

1. Field of the Invention

The present invention relates to the field of chamber blocks and specifically to removable chamber blocks for handguns or similar weapons.

2. Background Information

Gun safety is an increasingly important issue in the current political environment. Most of the discussion focuses on securing weapons in the home, especially where children are present. A different situation occurs in gun stores and at gun shows where weapons are offered for sale.

In an environment where weapons are offered for sale, there is a risk that a weapon may be loaded and fired, whether accidentally or intentionally. This risk leads to a desire to secure the weapons. However, the weapons must also be available for inspection and handling by the customers. This leads to a desire to leave the weapons unencumbered. Both problems are exacerbated in a gun show environment where high volumes of customers are handling the weapons and potentially buying.

The solution to this problem is most often described as a chamber block. This is a device which in some way blocks access to the chamber, preventing it from being loaded. Ideally, the chamber block will not interfere with any other operation of the weapon, but this goal is often not met.

Many designs for chamber blocks have been developed. Some utilize an element which fits within the chamber itself and grips the chamber walls in some manner to prevent removal of the block. One approach is to use two opposing parts which are drawn together, often by a threaded connection, causing one of the elements to offset or expand against the chamber wall or to compress a third element, such as an o-ring, which expands outward against the chamber wall. Another approach is to place one element within the chamber and connect it to another element positioned at the distal end of the barrel. The connecting element then draws them together, clamping them in position.

Most of the previous designs suffer from excess complexity with the resultant increased manufacturing and sale cost. Multiple parts are required and many require machined metal parts to handle the stresses inherent in their design.

Also inherent in the design of many existing chamber blocks is that all or part of the block must be inserted from the chamber end of the weapon. This can be inconvenient and may require partial disassembly, such as field stripping, of the weapon. This is inconvenient, especially where a wide variety of used weapons are displayed, each having a different stripping procedure.

When used weapons are being sold, it is especially important that the buyer have full access to inspect the weapon to determine wear, upkeep, and other characteristics unique to each weapon. Ideally, the buyer should be able to operate the weapon (such as working the slide), visually inspect the weapon, and even field strip the weapon as part of the inspection. Many chamber blocks and other safety devices interfere with this inspection process. This makes them undesirable and thus less likely to be used. Some existing solutions actually pose an increased safety risk by interfering with inspection. Those approaches which hold the slide closed do not allow verification that the chamber is not loaded, a check which is preferably performed by every person handling the weapon.

Ideally, a chamber block would also provide a visual indication that the weapon is safe. This would include a clear indication that the chamber itself is blocked, when viewed from the breach, and an external indication that the block is in place. Preferably the external indication would be visible from a significant distance, 15 or 20 feet as a minimum, so that other personnel can double check the use of the chamber block and easily verify that all displayed weapons are properly blocked. Few if any existing chamber blocks address this requirement.

It is important to note that the above problem is not that typically addressed by gun locks and chamber blocks do not serve as gun locks. A chamber block is intended for use where the weapon is under supervision by a responsible party but is being handled by a customer or other person. There is a need to hinder or restrict the ability to load the weapon, but minimal interference with inspection must also be achieved. Because supervision is always present, a lower level of security than that provided by a gun lock is suitable.

There is a need for a chamber block which is easy to use, inexpensive to manufacture, and which offers minimal interference with inspection of the weapon on which it is installed. Ideally, the device would block access only to the chamber itself and the inside of the barrel. Preferably, the block will be insertable from the barrel end of the weapon. The block should be sufficiently inexpensive that a dealer can reasonably afford to install a chamber block on every weapon on display. Ideally, it will provide a visual indication that it is in place and that the chamber is blocked. This indication should be apparent both from a distance and when inspecting the chamber of the weapon. Of course, the chamber block must also operate without damaging the weapon or its finish in any manner.

BRIEF SUMMARY OF THE INVENTION

The present invention is directed to an apparatus which blocks the chamber of a weapon, such as a handgun, preventing it from being loaded. The device is easily installed but then requires a reasonable amount of effort to remove, such that it can not be done surreptitiously. In all embodiments, the chamber block interacts solely with the chamber and barrel of the weapon for minimal interference with weapon inspection and operation, except for those alternatives where an enlarged collar is used to intentionally block slide movement.

According to a first embodiment of the invention there is provided a chamber block which is split lengthwise into two mirror image segments which extend from the chamber to beyond the distal end of the barrel. The middle portion is relieved so that when the segments are offset, they will pass through the barrel, but when aligned, they will not. A retaining mechanism such as a cable tie, or similar, holds the segments in alignment and prevents their withdrawal through the chamber end.

According to an aspect of the first embodiment of the invention the retaining mechanism may also comprise a collar which encircles the protruding end of the chamber block. A latch may also be incorporated into the chamber block to retain the segments in alignment.

According to a second embodiment of the invention, there is provided a two segment chamber block, one segment adapted to occupy the chamber of the weapon and a second segment adapted to fit into, over, or against the end of the barrel. A strap, such as that provided by a cable tie, secures the two segments together and retains them in position relative to the barrel. The strap may be integral to one of the segments or it may be a separate piece. The strap may be releasable, for easy removal, or it may be non-releasable, requiring that it be cut to free the chamber block.

According to an aspect of the second embodiment of the invention one or both segments may be of a two part construction, such as a clamshell arrangement, and adapted to capture a separate cable tie as a means for securing the chamber block.

According to a third embodiment of the invention the strap retaining the segments of the second embodiment may loop through one segment, having both ends secured in the other segment.

According to a fourth embodiment of the invention a chamber block is provided which comprises segments to be inserted into opposite ends of the barrel and which have opposing teeth which interlock to retain the segments in position within the barrel.

The chamber block may also be manufactured as a one-piece block with one or more of the disclosed retaining mechanisms.

The advantages of such an apparatus are a chamber block which is inexpensive to manufacture, easy to use, and which effectively blocks access to the chamber of the weapon while not interfering with any part of the weapon other than the barrel and chamber. The chamber block is preferably manufactured from plastic and is thus easy colored for visibility. The chamber segment is visible through the breach and the barrel segment protrudes beyond the end of the barrel and can be quite prominent depending on length.

The above and other features and advantages of the present invention will become more clear from the detailed description of a specific illustrative embodiment thereof, presented below in conjunction with the accompanying drawings.

DETAILED DESCRIPTION OF THE INVENTION

Figure 1:
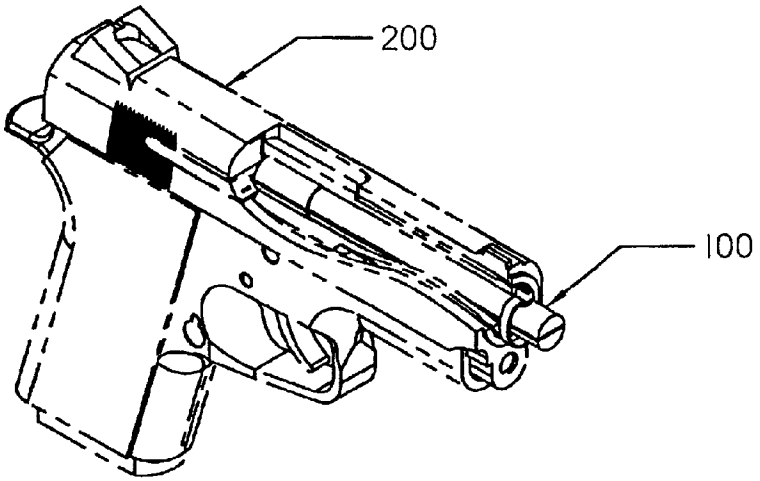
FIG. 1 is a perspective view of the preferred embodiment of the inventive chamber block in position in a handgun.

The following discussion focuses on the preferred embodiment of the invention, a chamber block for a semi-automatic handgun. However, as will be recognized by those skilled in the art, the disclosed method and apparatus are applicable to a wide variety of situations in which blocking the camber and/or barrel of any weapon is desired.

The disclosed invention is described below with reference to the accompanying FIGS. in which like reference numbers designate like parts. Generally, numbers in the 200's refer to prior art elements or elements in the surrounding environment while numbers in the 100's refer to elements of the invention.

Glossary

The following is a brief glossary of terms used herein. The supplied definitions are applicable throughout this specification and the claims unless the term is clearly used in another manner.

Cable Tie—this term is intended to be interpreted broadly to include a range of similar devices used to tie cables into bundles or perform similar functions. Common forms include a flat strap configuration with teeth or ridges on one side which engage a toothed pawl in the head of the tie; a similar form which uses a metal prong or tooth projecting into the passageway in the head which engages the teeth; ladder-like configuration with cross rungs and relatively wide spaces in between which likewise engage teeth or hooks in the head; a configuration with a generally round strap resembling a chain of beads engaged by a slot in the head which fits the reduced diameter portion between the beads; and other devices of the same sort. Generally, any device which can passed around or through another item and then engage or latches to itself would be applicable and considered equivalent to a cable tie for the purposes of this document.

Diameter, Radius—when used with reference to the chamber block, these terms generally refer to the distance to the outermost portion of the chamber block, orthogonal to the longitudinal axis, diameter measured from the opposite side, radius from the axis itself or from the inner side of the portion of the chamber block being discussed. Since the preferred embodiments incorporate a circular cross section, these terms are used conventionally therewith. Where an embodiment with non-circular cross section is discussed these terms should be understood to have an analogous meaning.

Retaining mechanism—a device which retains the chamber block in position by preventing its withdrawal from the barrel. In some embodiments it may also retain the segments of the chamber block in proper alignment. The use of a removable device such as a cable tie is preferred, but other devices, including padlocks, is also anticipated. If desired a length of cord or cable can be used to interconnect several chamber blocks, and thus weapons, and to secure them to a display table or other fixture. The cable may also be part of an alarm system as is commonly used with weapons, computers, and other valuable merchandise. Clearly a single weapon could also be secured in this manner. The retaining mechanism may also include a sleeve or collar which fits over the chamber block and is held in place by the cable tie or similar.

Weapon—Although the preferred embodiments are discussed herein with respect to use with a handgun, and specifically a semi-automatic handgun, this term is intended to encompass any handgun, rifle, shotgun or similar weapon having a barrel and chamber which can be blocked in a manner similar that described herein.

Overview

The accompanying illustrations show a variety of embodiments of a chamber block for a handgun or similar weapon. They share the common characteristics of preventing ammunition from being inserted into the chamber, thus preventing the weapon from being fired, while not interfering with inspection of the majority of the weapon (all except the interior of the barrel and chamber) and not interfering with stripping the weapon or working the action of the weapon. This is desirable in a sales situation, especially of used weapons, where the buyer desires to inspect the weapon and the seller desires to reduce the risk of accidental or intentional discharge of the weapon. Most existing safety devices of a similar nature interfere with the buyer's inspection. Some actually pose a safety risk because they lock the action closed, preventing a person handling the weapon from verifying that the chamber is empty.

The device disclosed herein is intended to block or limit access to the chamber and/or barrel of a weapon, thus making it more difficult to insert ammunition. It is not intended as a lock as would be needed, for example, to prevent a child from firing the weapon. In most embodiments, the block can be removed by cutting an element of the block, such as the strap of a cable tie. The block is intended for use where the weapon is under the control of an adult, such as a salesperson, and an additional level of safety is desired. The present chamber block could be combined with a conventional locking device for additional safety.

Figure 2:
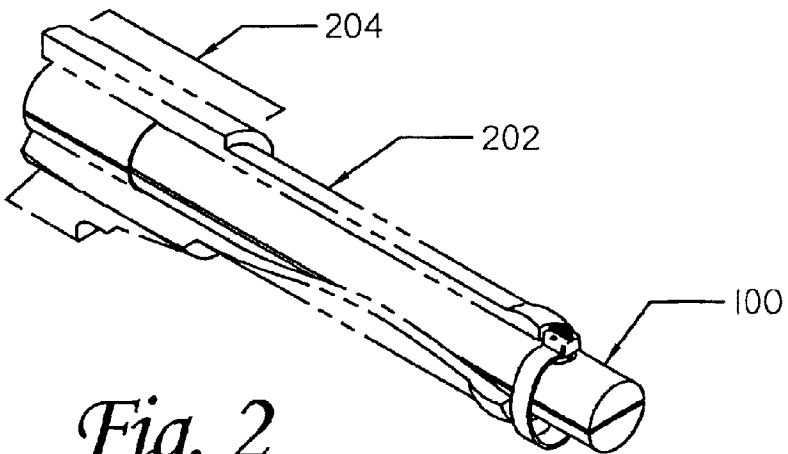
FIG. 2 is a perspective cutaway view of the preferred embodiment of the inventive chamber block in position in a handgun barrel.
Figure 3:
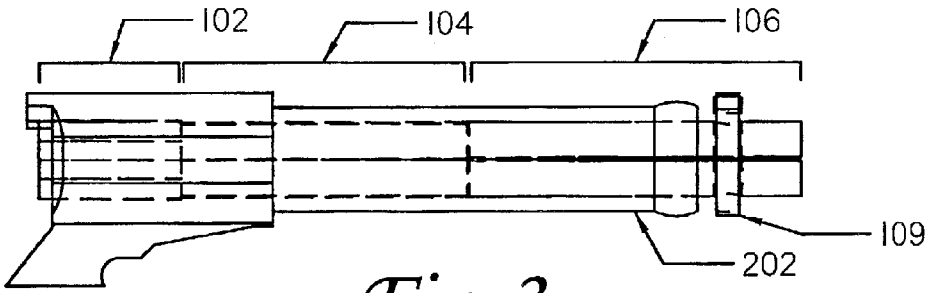
FIG. 3 is a side view of the preferred embodiment of the inventive chamber block in position in a handgun barrel.
Figure 4:
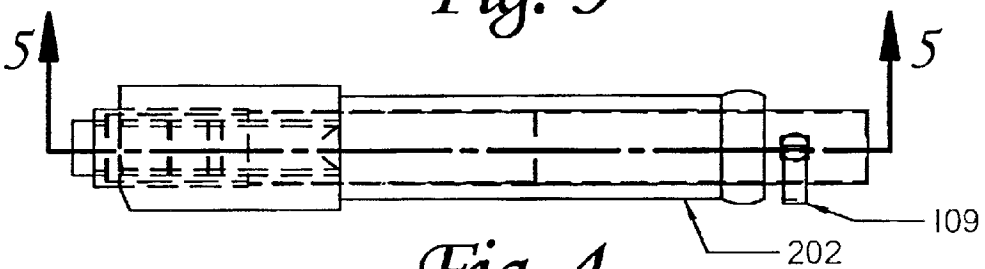
FIG. 4 is a top view of the preferred embodiment of the inventive chamber block in position in a handgun barrel.
Figure 5:
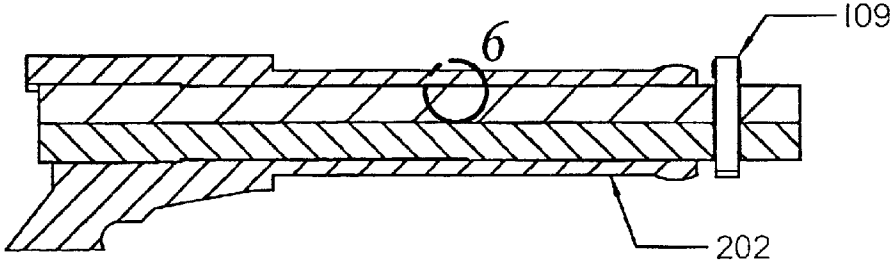
FIG. 5 is a cross section of the preferred embodiment of the inventive chamber block in position in a handgun barrel.
Figure 6:
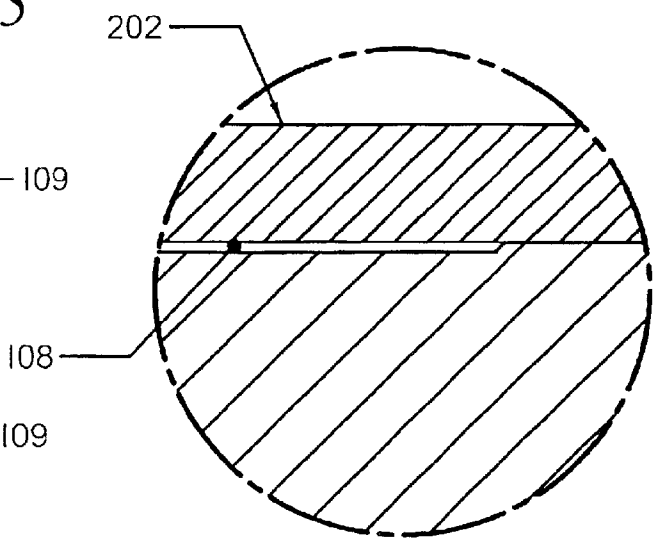
FIG. 6 is a detailed cross section view of the preferred embodiment showing the clearance gap.

FIGS. 1 and 2 illustrate the general method of using the chamber block in a handgun, 200, FIG. 1, and in more detail with only the barrel, 202, illustrated, FIG. 2. The chamber block is placed in the barrel of the weapon with a portion occupying the chamber, 204, and the distal end protruding from the end of the barrel. The chamber portion has too great a diameter to be drawn forward through the barrel and some retaining mechanism (a cable tie in the illustrated embodiment) prevents the chamber block from being removed rearward through the chamber. The chamber block is thus held captive within the barrel and chamber and prevents the chamber from being loaded with ammunition. The various embodiments address different methods of inserting and retaining the chamber block but all perform the same basic function of blocking the chamber.

Note that in most of the figures, only the barrel of the weapon is illustrated. This is for clarity purposes only. It should be understood that the chamber block is typically used with a fully assembled weapon.

The chamber block also provides visual indication that the block is in place. That portion of the block which extends beyond the end of the barrel is readily visible. This can be enhanced by coloring the block with a highly visible color, such as red or "safety orange." This feature allows a salesperson, or other person responsible for the weapon, to verify from a distance that the block is still in place in the weapon.

Throughout the following, many of the components are illustrated with a circular cross section where they interact this the barrel, that cross section taken in a plane orthogonal to the longitudinal axis of the barrel. This is not a requirement of the invention. Any other appropriate shape can be used as long as it performs the same function. As examples, a rectangular, triangular or a three legged shape, 178 in FIG.

35, which spans the chamber has been found to be effective for the chamber portion. Further, it need not have a significant longitudinal length. One alternative shape is to make the ends spherical of the appropriate diameter. As long the block fits within the chamber but can not be drawn into the barrel, any shape fulfills the functional requirements of that portion of the chamber block. Generally, the chamber portion of the block will be a close fit to the chamber, to assure that it can not enter the barrel. A looser fit is acceptable as long as it can not enter the barrel. When using some materials, which are at least slightly compressible, the block may actually be made slightly larger than the chamber, for a press fit. Similar requirements are applicable to the barrel end, independent of shape.

Preferred Embodiment

The currently preferred embodiment of the inventive chamber block utilizes two cooperating segments, each segment having three portions. The chamber portion is sized to be closely received within the chamber. The barrel portion is sized to fit the within the barrel, preferably but not necessarily a close fit. The reduced radius portion is just ahead of the chamber portion and smaller in radius than the inside of the barrel. When aligned, the chamber portions of the two segments have a combined diameter which is larger than the inside diameter of the barrel, preventing the withdrawal of the chamber block through the barrel. When the chamber portion of one segment is aligned with the reduced radius portion of the other, their maximum combined diameter is less than or equal to the inside diameter of the barrel, allowing the chamber block to be inserted or removed. A significant advantage of this embodiment is that it can be inserted and removed from the barrel end of the weapon making it easy to use and potentially more widely applicable.

Generally it will be necessary to slightly relieve the corners of the chamber portion of the segments. This allows the chamber portion to fit within the barrel bore at a slight offset from center when paired with the reduced radius portion.

If desired, the reduced radius portion could extend to the distal end of the chamber block subsuming the barrel portion. While not effecting the performance of the chamber block, this would allow the distal end to move at least a small amount laterally relative to the barrel which might be aesthetically undesirable and may allow the retaining mechanism to wear against the end of the barrel. However, where tight tolerances are held, the difference in radius is quite small and the amount of movement may be unnoticeable. For the chamber block to function, it is only necessary for one of the segments to have the reduced radius portion. However, it is preferred that both segments have the reduced radius portion so that they may be inserted in any order.

Two versions of this embodiment are illustrated, differing only in how the reduced radius portion is formed. FIGS. 3–9 depict a first version in which the outer radius of the reduced radius portion, 104, is decreased relative to that of the barrel portion, 106. As shown in the detailed view of FIG. 6, this results in a small gap, 108, between the reduced radius portion of the chamber block and the inner wall of the barrel. With the chamber block manufactured from a material which is at least slightly flexible, the reduced radius portion flexes to provide the necessary clearance as discussed below.

Figure 7:
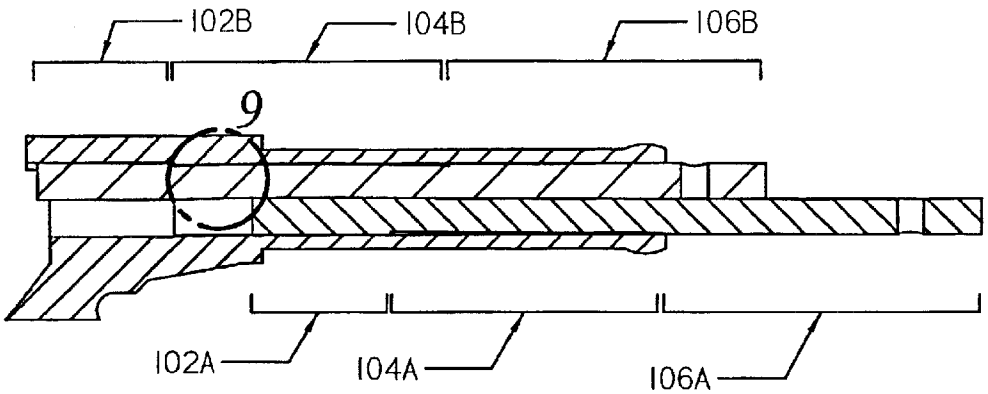
FIG. 7 is a cross section of the preferred embodiment as it is being inserted in the barrel, with the second segment still within the barrel.
Figure 8:
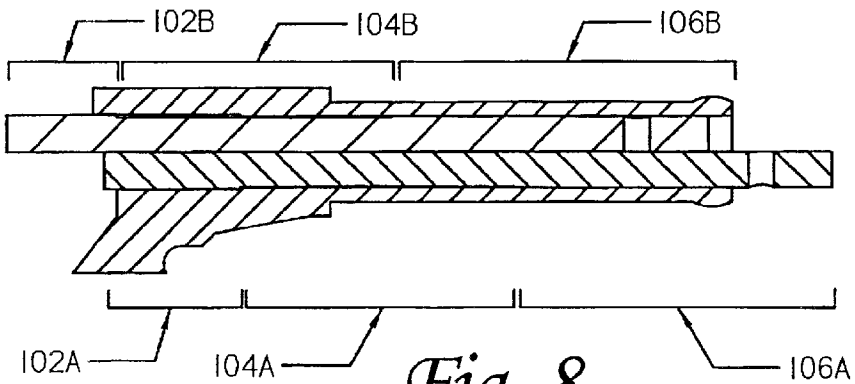
FIG. 8 is a cross section of the preferred embodiment as it is being inserted in the barrel, with the second segment within the chamber.
Figure 9:
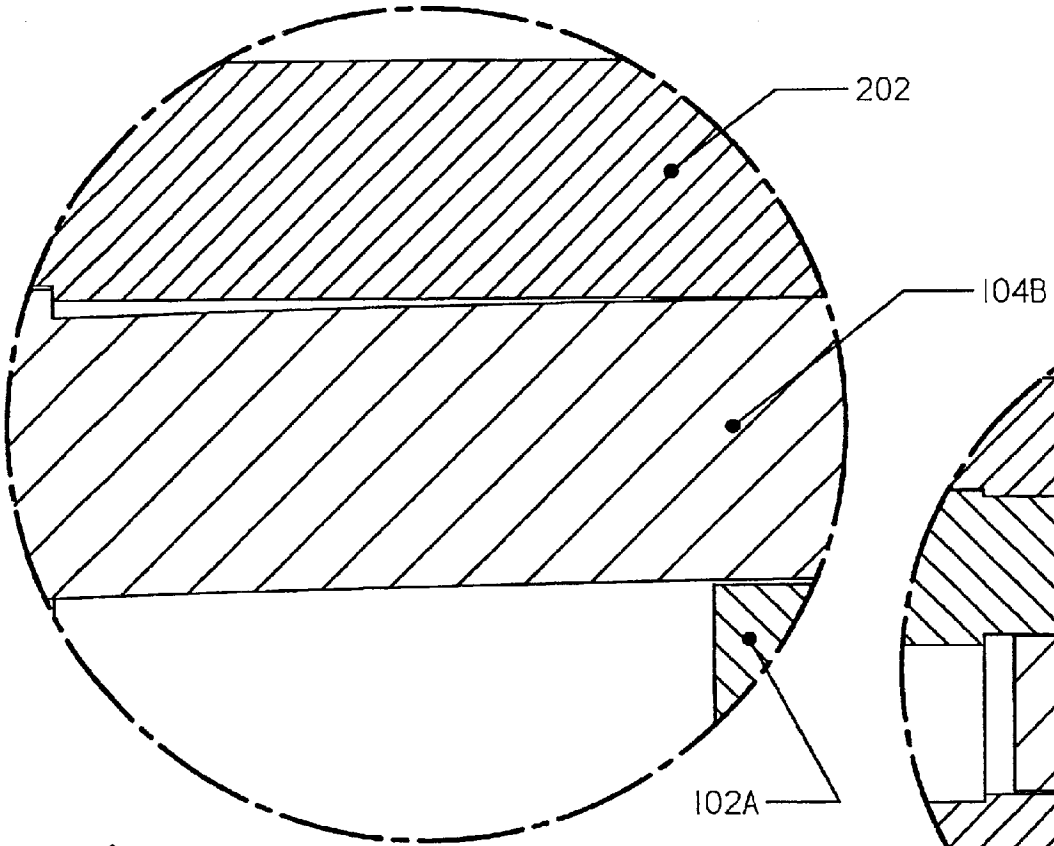
FIG. 9 is a detailed cross section view of the preferred embodiment illustrating the flexing of the first segment.

FIGS. 3–6 illustrate the chamber block in its installed position within the barrel of the weapon. FIGS. 7–9 illustrate the sequence of steps involved in inserting the chamber block. As shown in FIG. 7, the two segments are initially offset so that the chamber portion, 102A, of a first segment is aligned with the reduced diameter portion, 104B, of the second segment. The paired segments are then inserted into the end of the barrel, chamber portion first. As shown in FIG. 9, the reduced diameter portion, 104B flexes outward, offsetting the inner surface and providing room for the chamber portion, 102A, of the first segment to enter the barrel. The segments remain in their relative positions as the chamber block is inserted until the chamber portion, 102A, of the first segment reaches the chamber and is freed to move outward in the greater diameter of the chamber. At this time, the chamber block is in the position illustrated in FIG. 8 with the chamber portion, 102A, of the first segment within the chamber and the chamber portion, 102B, of the second segment extending at least somewhat beyond the chamber. (Clearly, if the chamber portions of the chamber block segments were made shorter than the chamber itself, both chamber portions could be entirely within the chamber. This would have the advantage of allowing the chamber block to be inserted with the chamber closed.) The second segment is then drawn, or pushed, toward the barrel end, bringing it into alignment with the first segment and the segments secured with the retaining mechanism, 109. This is the position illustrated by FIG. 3. Where the chamber block is only slightly longer than the barrel, as illustrated, it may be necessary to push the second segment forward by inserting a finger, or other object, in the breech of the weapon. If desired, the chamber block can be made longer so that the end of the barrel portion protrudes from the end of the barrel at all times, allowing the second segment to be drawn into position by pulling the barrel end of the segment.

Figure 12:
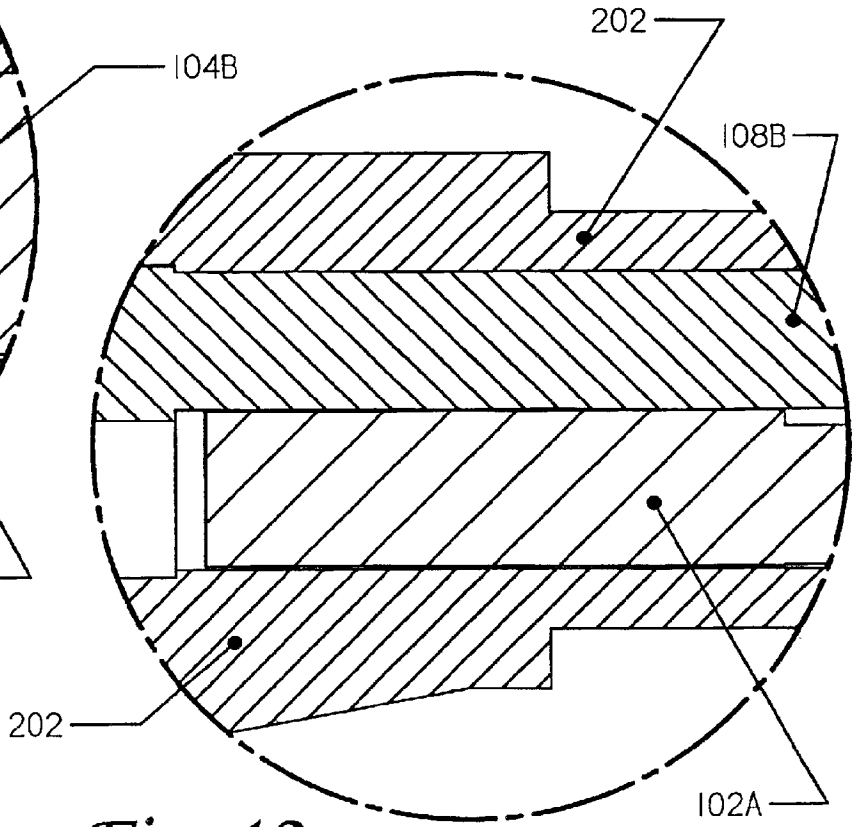
FIG. 12 is a detailed cross section view of the second version of the preferred embodiment illustrating the gap formed by relieving the inner surface.
Figure 10:
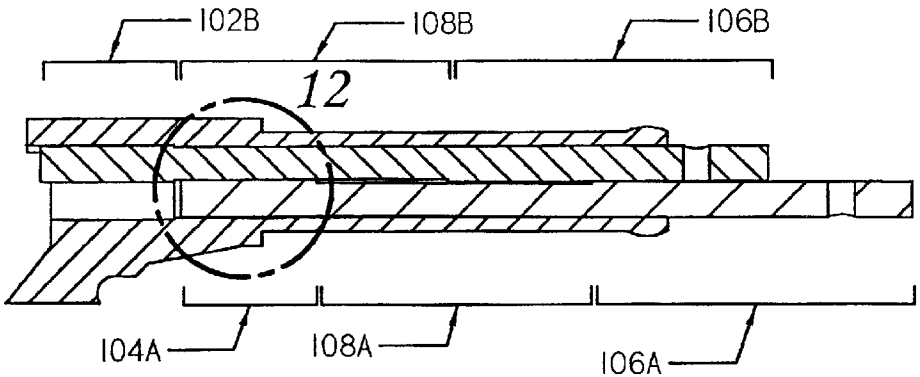
FIG. 10 is a cross section view of the second version of the preferred embodiment as it is being inserted.
Figure 11:
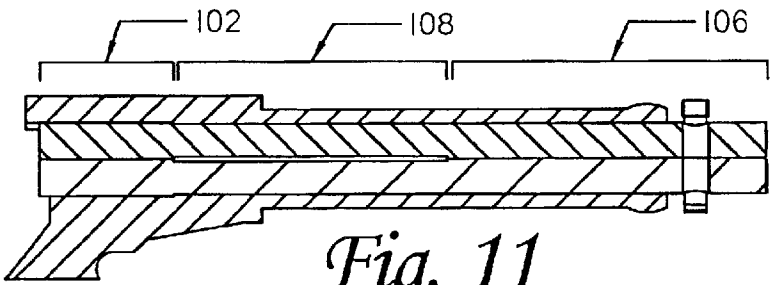
FIG. 11 is a cross section view of the second version of the preferred embodiment installed in the barrel.
Figure 13:
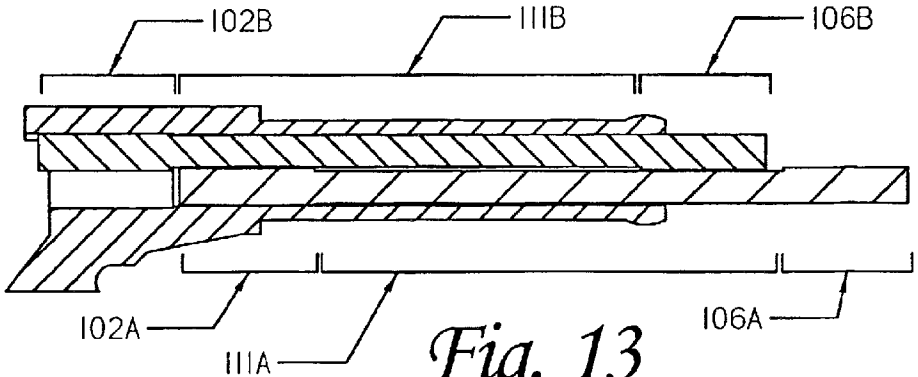
FIG. 13 is a cross section view illustrating an alternative configuration of the second version where the gap is long enough to accommodate the barrel portion of the opposing segment.

FIGS. 10–12 illustrate a second version of the preferred embodiment. As discussed above, this version differs only in the manner of forming the reduced radius portion, 108, of the chamber block segments. In this version, the inner surface of the reduced radius portion has been relieved, forming a step, or gap, to receive the opposing chamber portion. This gap is clearly shown in FIG. 11 and detailed in FIG. 12. The manner of inserting the chamber block, and the sequence of steps, is the same as for the first version. The configuration illustrated requires that the first segment flex slightly to allow the chamber portion to offset into the provided gap while within the barrel. If preferred, the reduced radius portion could have a length at least as great as that of the barrel portion, see FIG. 13. This would allow the reduced radius portion, 111A, of the first segment to receive the barrel portion, 106B, of the second segment at the same time that the reduced radius portion, 111B, of the second segment receives the chamber portion, 102A, of the first segment. This would eliminate the need for any flexing and allow the use of substantially rigid materials such as brass or aluminum.

An optional design element is to form a second, possibly larger, hole through one or both segments. This second hole would accommodate a cable, or similar, for interconnecting or securing the weapons while the first hole would be used to align and interlock the segments. This would allow the weapons to be secured to table, display case, or other fixture by the cable. When released from the cable, the cable block would still be retained within the weapon by the retaining mechanism.

Figure 26:
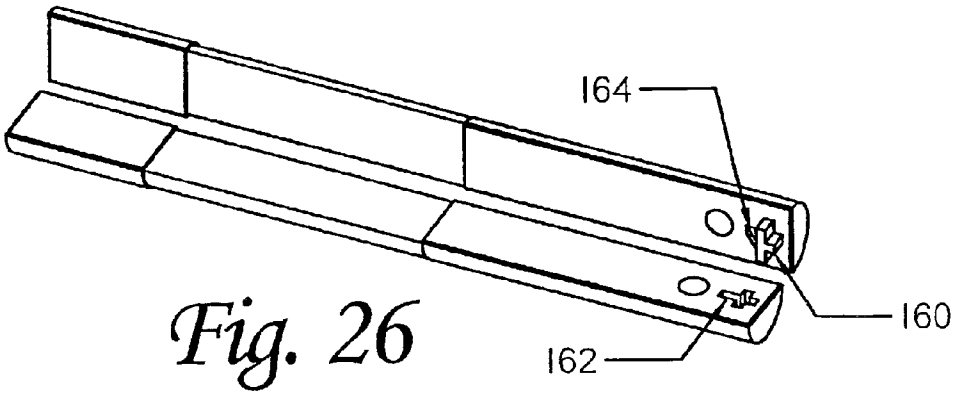
FIG. 26 illustrates the optional latch for use with the preferred embodiment.

FIG. 26 illustrates an optional catch which can be used to interconnect the two segments. It consists of a protrusion, 160, on one segment and a matching socket, 162, on the other. When the segments are aligned, the protrusion and socket mate, locking the segments together and preventing relative linear movement. Ramp, 164, formed as part of the protrusion makes it easier to slide the segments together. The segments can be released by flexing the segments apart until the catch is released. This approach provides an additional level of security because the catch will not be immediately apparent to the casual observer. If desired, the user of the device can rely solely on the catch to retain the chamber block. For an increased level of security, a cable tie may be inserted throughout the segments as described above. A further increase is obtain by using a padlock in place of the cable tie.

Figure 27:
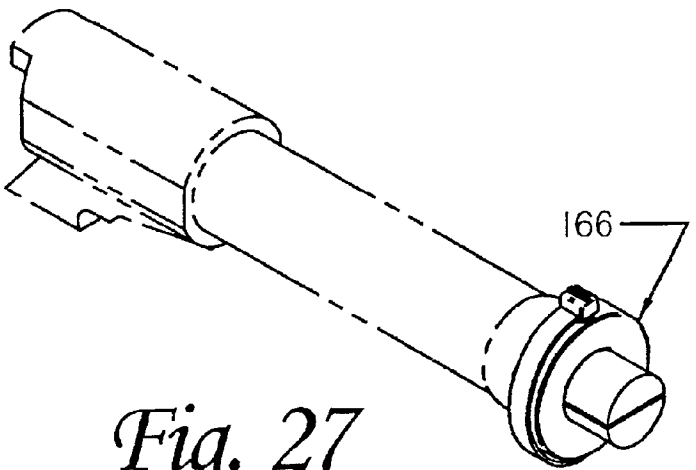
FIG. 27 illustrates the optional collar for use in retaining the chamber block.

FIG. 27 illustrates an optional collar, or sleeve, 166, placed over the end of the chamber block as part of the retaining mechanism. This may provide more positive retention of the chamber block and can also serve to prevent field stripping of the weapon in some cases. It is common for the slide to be moved forward past the end of the barrel or for the barrel bushing to be removed as an early step in field stripping some weapons. Where the collar is of sufficiently large diameter to interfere with such movement of the slide or bushing removal, the weapon can not be field stripped with the collar in place. This may be desirable for some users. Alternatively the collar could be retained by threads, lugs, cams or similar either alone or in combination with a retaining mechanism such as a cable tie.

First Alternative Embodiment

Figure 16:
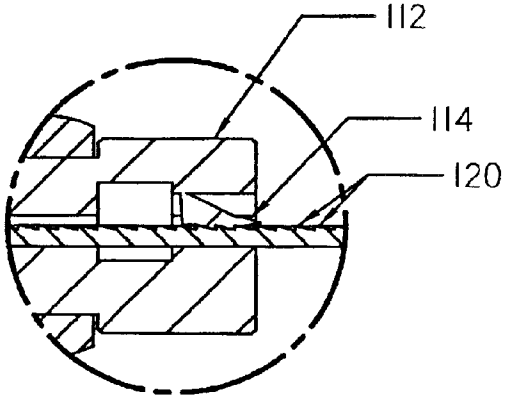
FIG. 16 is a detailed view of the barrel end portion of the first alternative embodiment.
Figure 17:
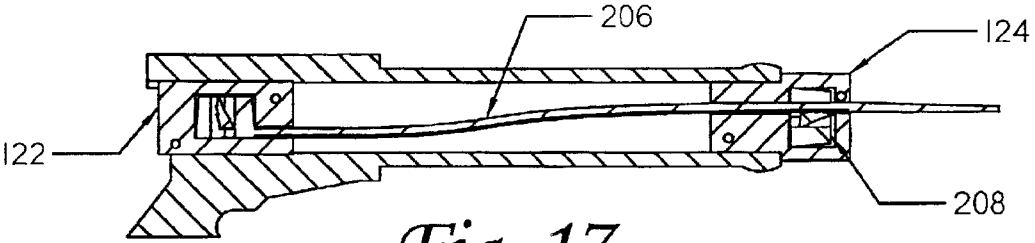
FIG. 17 is a cross section through the first alternative version of the first alternative embodiment installed in a barrel.
Figure 18:
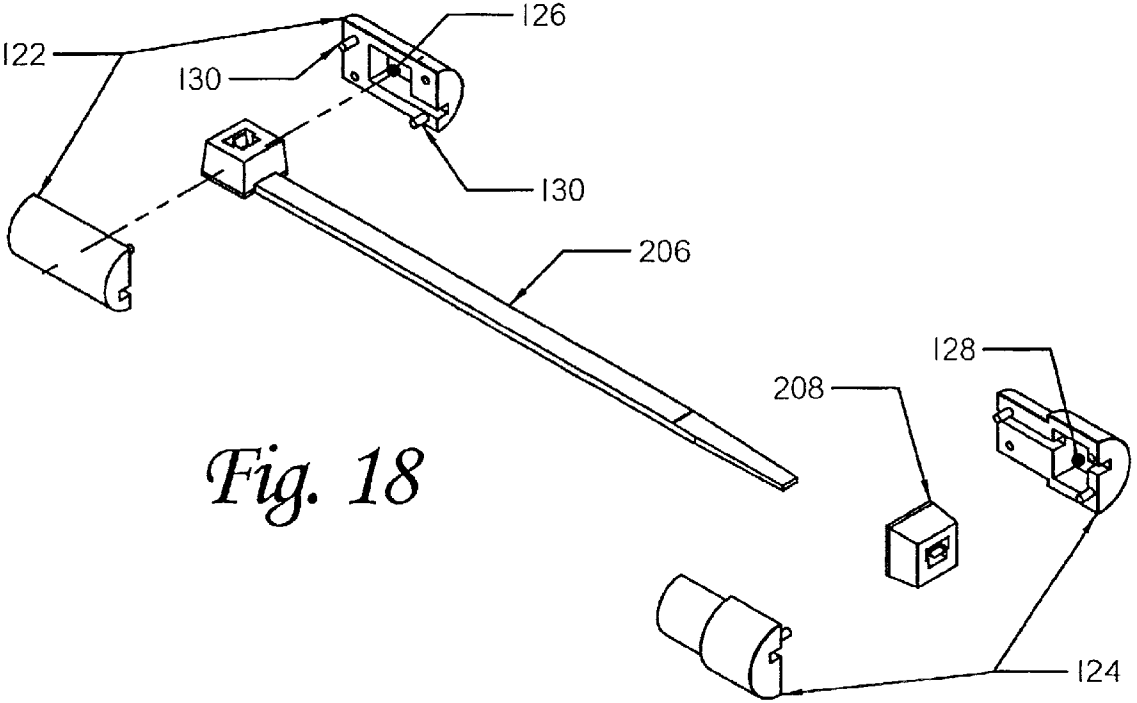
FIG. 18 is an exploded view of the first alternative version of the first alternative embodiment.

The first alternative embodiment of the present inventive chamber block utilizes a flexible strap and catch mechanism similar to that of a cable tie to hold a chamber portion and a barrel end portion in place in the barrel. This embodiment also is illustrated in two versions. The first, shown in FIGS. 14–16 utilizes a strap formed integrally with the chamber portion and a catch mechanism integral with the barrel end portion. The second version, shown in FIGS. 17–18 is adapted to use a conventional cable tie and the head portion of a second, compatible, cable tie to retain the two portions in position.

Figure 14:
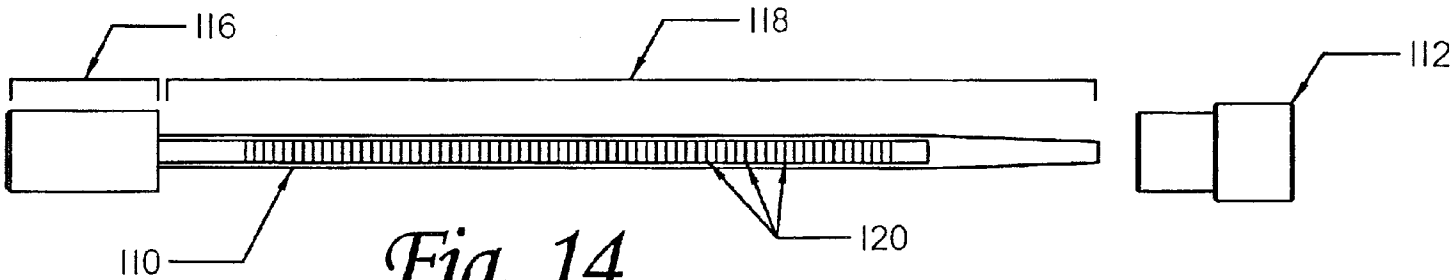
FIG. 14 illustrates the parts of the first alternative embodiment of the inventive chamber block.
Figure 15:
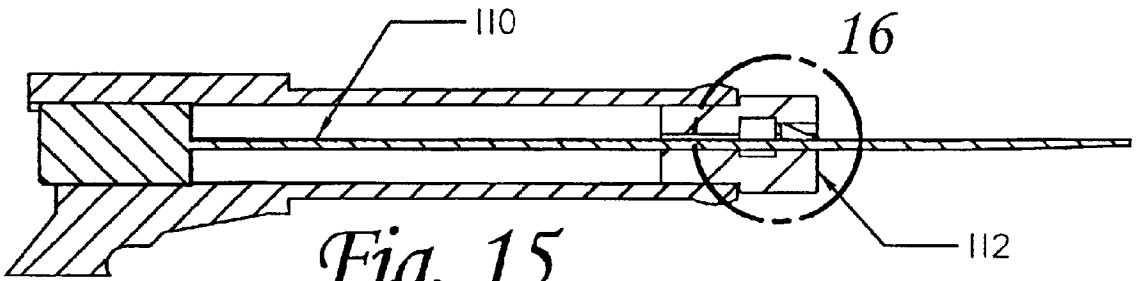
FIG. 15 is a cross section through the first alternative embodiment installed in a barrel, in the same plane as FIG. 5.

Referring to FIGS. 14 & 15, the components of the first version are illustrated. The chamber portion, 110, comprises an enlarged section, 116, which is sized to fit into the chamber but to be too large in diameter to be drawn into or through the barrel. It also has an elongated strap portion, 118, which is adapted to extend through the barrel and connect to the barrel end portion, 112. The barrel end portion preferably has a region with a diameter small enough to be inserted into the end of the barrel and another region of larger diameter which can not be drawn into or though the barrel. Alternatively, the portion which fits into the barrel may be very short, or even non-existent, so that the barrel portion will fall free of the barrel unless retained by the cable tie. This would provide a visual indication that the chamber block is intact and in place. Where the weapon has a barrel which protrudes beyond the slide, the barrel end portion could fit over the end of the barrel.

This version of the chamber block is used by inserting the chamber portion into the chamber, strap end first, so that the strap extends out of the barrel end. The strap can then be grasped and pulled to fully draw the enlarged region into the chamber. The barrel end portion is then placed over the end of the strap portion with the pawl, 114, engaging the teeth, 120, on the strap, see FIG. 16. The barrel end portion is moved towards the chamber portion until it contacts, and preferably partially enters, the end of the barrel. The strap is pulled tight to minimize relative movement of the two portions of the chamber block. If desired, the excess length of the strap, where it extends beyond the barrel end portion, can be trimmed off.

The block is removed either by releasing the latch, similar to a re-usable cable tie, or by cutting the strap portion inward of the catch. Cutting would likely require an opening in the portion containing the catch to provide access to the strap by knife blade, diagonal cutters, or similar. The illustrated arrangement is preferred, especially where release by cutting is anticipated, for better access. However, the catch portion could also be positioned within the chamber and the strap portion positioned at the barrel end.

Referring to FIGS. 17–18, the second version of the first alternative embodiment can be seen. It functions in the same manner as the first version, except that it is adapted to use standard cable ties rather than an integrally molded strap and catch mechanism. The chamber portion, 122 comprises two semi-circular halves which define a chamber, 126, of a size and shape to receive the head of a conventional cable tie with the strap extending through the end. Optional pins, 130, screws, or similar serve to align and retain the two halves. As illustrated, two equally sized, symmetric halves are used with a portion of the chamber formed in each half. While preferred, this is not required. The entire chamber could be formed in a larger section with a smaller section used to cap the chamber or a single cylindrical piece could be used with the chamber open to one, or both, sides or to the rear.

The barrel end portion, 124, is also preferably formed of two mating semi-circular halves which define a chamber. This chamber is sized and shaped to receive only the head portion of a cable tie, oriented to receive the strap of the cable tie captured by the chamber portion. Preferably, the head portion is formed by cutting the strap from a cable tie of the same configuration as that used with the chamber portion. As with the chamber portion, the barrel end portion need not be symmetric and could be formed as a single piece.

A significant advantage of this second version is that it allows the user to select any desired cable tie for use with the block including releasable or non-releasable; different styles or catch mechanisms; different strengths (for ease or difficulty of cutting for example); or even for different colors.

Figure 21:
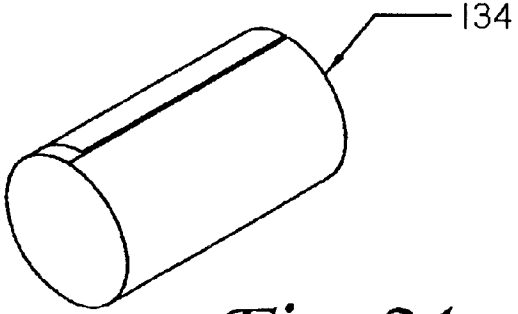
FIG. 21 illustrates another asymmetric version of the chamber portion of the first alternative embodiment adapted to provide a firing pin striking surface.
Figure 22:
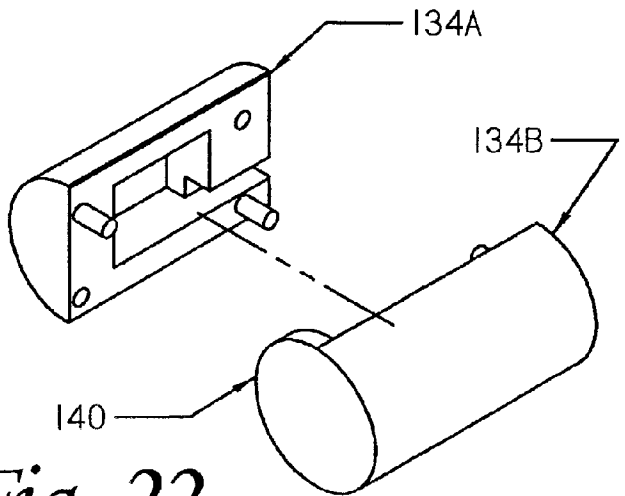
FIG. 22 is an exploded view of the embodiment of FIG. 21.
Figure 19:
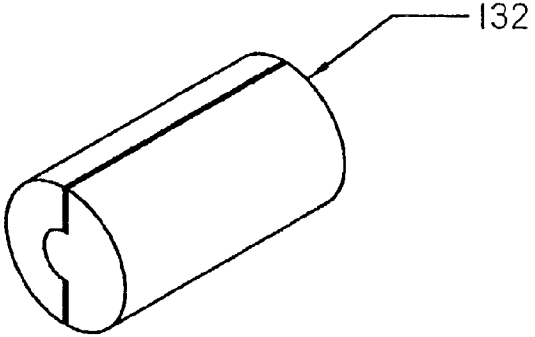
FIG. 19 illustrates an asymmetric version of the chamber portion of the first alternative embodiment adapted to provide a firing pin striking surface.
Figure 20:
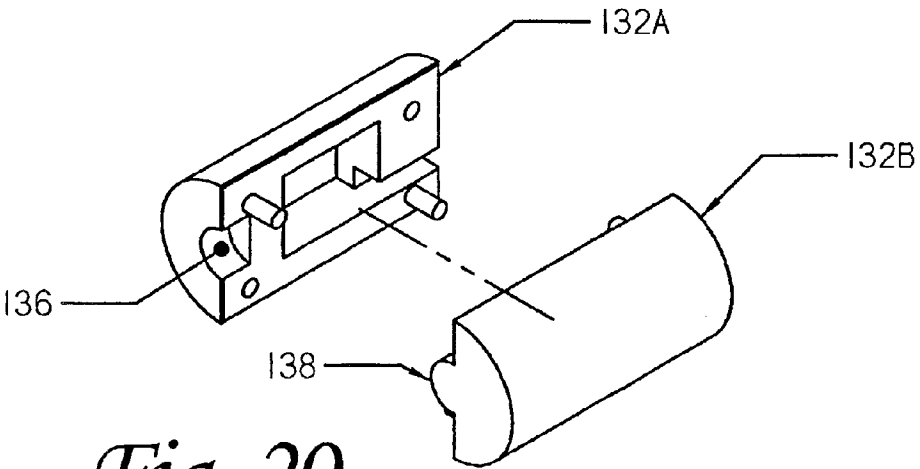
FIG. 20 is an exploded view of the embodiment of FIG. 19.

The first version of this alternative embodiment presents a relatively smooth face to the rear of the chamber. Where the length of the chamber portion is substantially the same as the length of a cartridge for the weapon with which it is used, the present invention is also capable of functioning as a "snap cap" type of device wherein it provides a surface against which the firing pin can strike when dry firing. The second version, as illustrated above, would not function well for that purpose because the firing pin would strike on or near the line where the two halves mate. To improve its functionality in this role, the second version may be made asymmetric, 132, as shown in FIGS. 19 and 20, or with one part overlapping the other, 134, as in FIGS. 21 and 22, so that a solid face is presented in the area where the firing pin strikes. In the asymmetric version one half, 132A, defines a cavity, 136, which receives a protrusion, 138, formed on the other half, 132B. The overlapping version uses a first half, 134A, which is shorter than the second half, 134B. The end, 140, of the second half then extends over the end of the first half, presenting a solid face to the firing pin.

Second Alternative Embodiment

Figure 23:
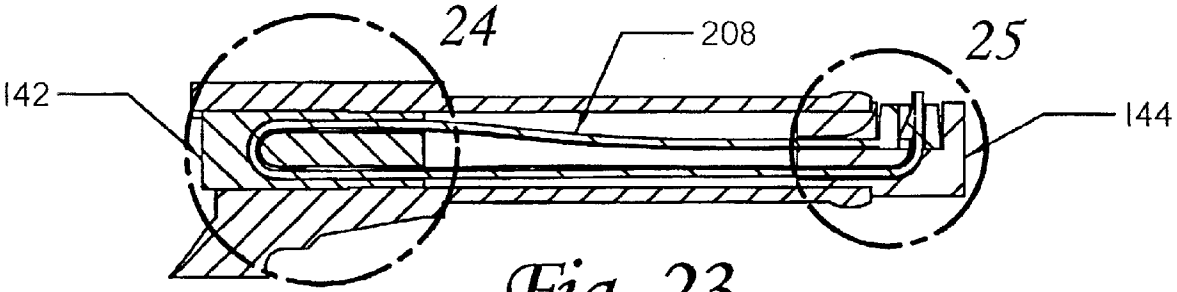
FIG. 23 is a cross section through the second alternative embodiment installed in a barrel, in the same plane as FIG. 5.
Figure 25:
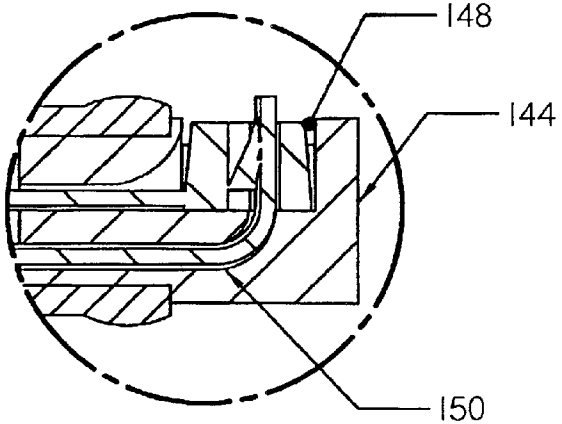
FIG. 25 is a detailed cross section view of the barrel portion of the second alternative embodiment.
Figure 24:
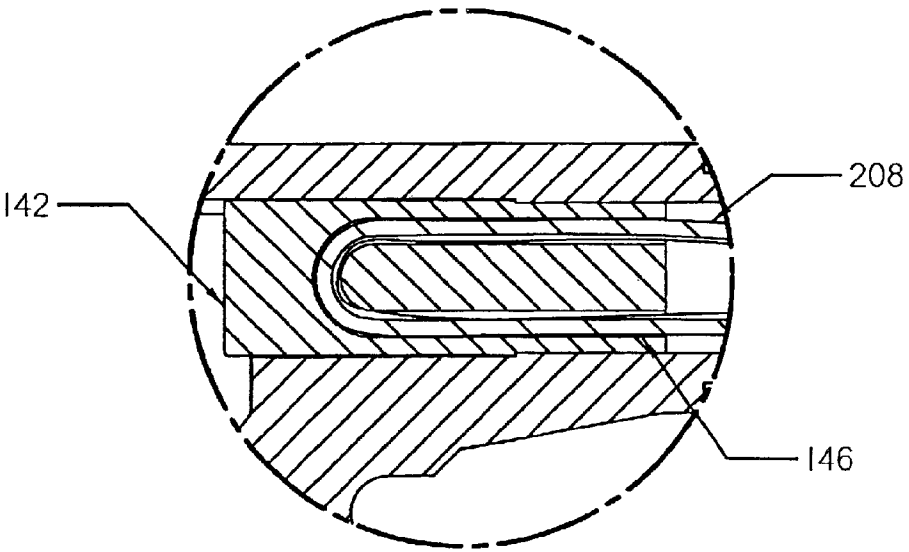
FIG. 24 is a detailed cross section view of the chamber portion of the second alternative embodiment.

A second alternative embodiment of the present inventive chamber block is illustrated in FIGS. 23–25. Much like the first alternative embodiment, this embodiment utilizes a chamber portion, 142, and barrel end portion, 144, joined by a cable tie, 208. The difference is that a single cable tie is used and it is looped through the chamber portion and back to the barrel end portion to connect to itself. If desired, the positions could be reversed, with the ends of the cable tie positioned at the chamber end and looped through the part at the barrel end. As above, any appropriate conventional cable tie can be used and the chamber block may be released by either releasing the catch or cutting the cable tie.

FIG. 24 is a detailed view of the chamber portion through which the strap loops. While shown with an enclosed passage, this is not required. A single pin, substantially transverse to the chamber (or barrel) is sufficient. If desired, such a pin need only be attached at one end to the block portion. If desired, it could also be removable, such as to allow the strap to be looped and inserted into an opening which is then spanned by the inserted pin, retaining the strap in place.

FIG. 25 is a detailed view of the barrel end portion which receives the ends of the cable tie. The preferred embodiment defines a chamber, 148, which receives the head of the cable tie so that the strap is aligned with the barrel and the passage through the head is perpendicular to the bore of the barrel. Passage, 150, receives the free end of the strap and guides it through a curve to meet the head of the tie and continue on to exit to the side. Alternatively, the head could be bent, or folded over, and the free end of the strap exit straight out through the end of the block portion.

Third Alternative Embodiment

Figure 28:
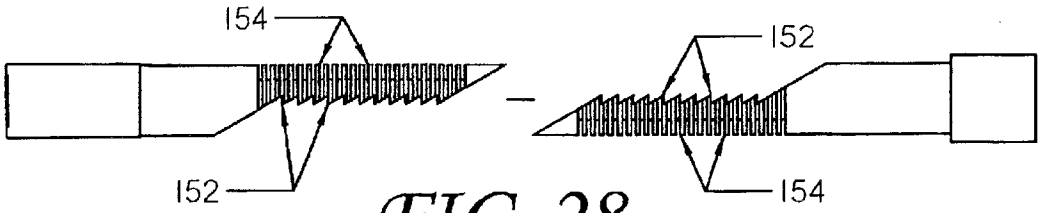
FIG. 28 illustrates the parts of the third alternative embodiment of the inventive chamber block.
Figure 29:
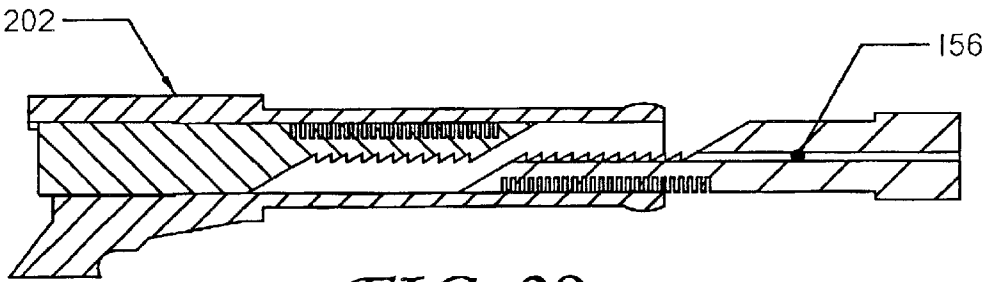
FIG. 29 is a cross section through the third alternative embodiment as it is being inserted in a barrel, in the same plane as FIG. 5.
Figure 30:
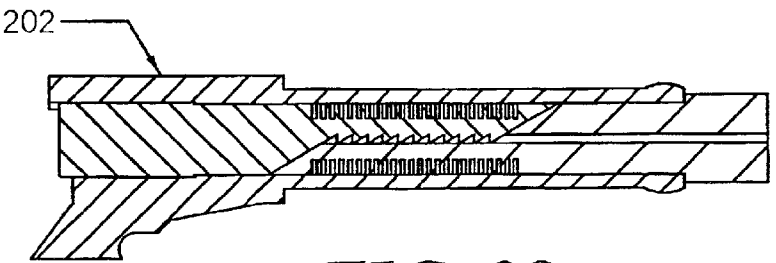
FIG. 30 is a cross section through the third alternative embodiment installed in a barrel, in the same plane as FIG. 5.

FIGS. 28–30 illustrate a two piece chamber block utilizing opposing cooperating teeth, 152, to lock the segments together. Ribs, fingers, or similar members, 154, opposite the teeth bear against the inner surface of the barrel urging the teeth together while still allowing sufficient clearance, when flexed or compressed, for the teeth to bypass so that the segments of the block can be mated. Where the material is sufficiently resilient, the ribs can be eliminated. As an alternative, the block may be composed of two or more materials. A harder or more rigid material can be used for the teeth and a more resilient material for the fingers. The materials may be arranged in any suitable manner include, but not limited to flat or concentric layers A central passage, 156, is formed in one of the pieces to accommodate the release key. Clearly this passage could be in either segment. Where it is in the barrel end segment (as shown) the block can be easily removed without disassembly of the weapon. Where the passage is in the chamber end piece, access is restricted and disassembly may be required, which provides increased security. The release key preferably functions in a manner similar to a wedge, forcing the two pieces apart and disengaging their teeth. It may do this by flexing, or compressing, the body, or shaft, of the piece, or by compressing or flexing the teeth themselves. A simple, round rod has been found to perform adequately. A rod of any desired cross-sectional shape would work and matching the cross section to the shape of the hole would "personalize" the key, requiring a matching release key to release the block. If desired, a shape with varying circumference (such as an oval) can be used so that the key may be inserted with reduced effort and then turned to force the sections apart.

FIG. 30 illustrates the two parts of the chamber block fully mated within a barrel. The two segments will also lock together at any point short of fully mated where the teeth are engaged. This allows a single length of chamber block to be used with various length barrels.

Fourth Alternative Embodiment

Figure 31:
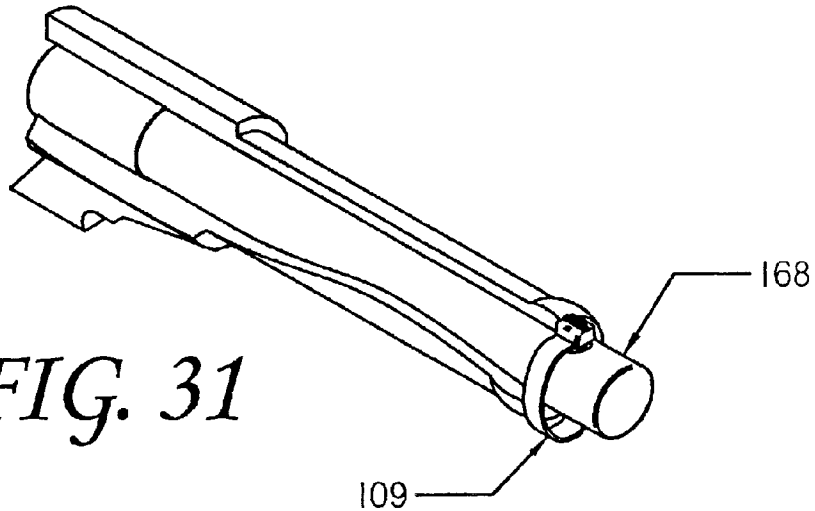
FIG. 31 is a cutaway view of the fourth alternative embodiment of the inventive chamber block installed in a barrel.
Figure 32:
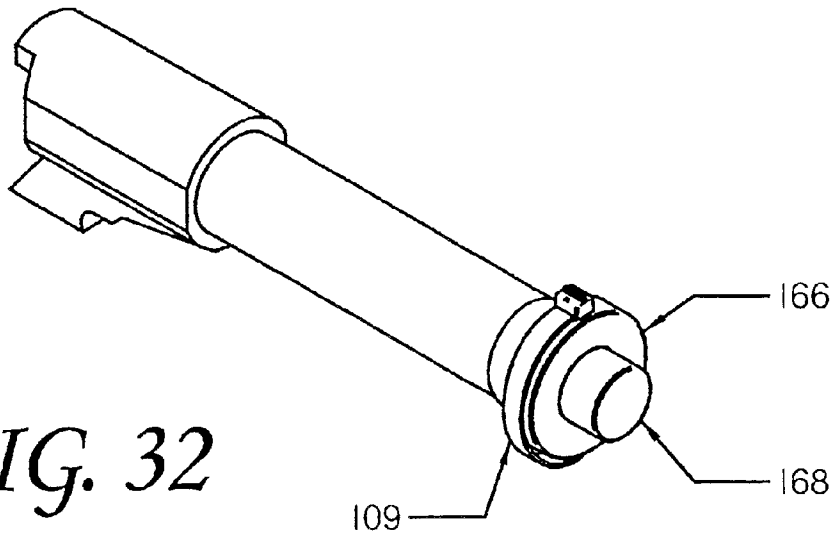
FIG. 32 illustrates the fourth alternative embodiment with a retaining collar installed.

The inventive chamber block could also be manufactured as a one-piece solid block, 168, as shown in FIGS. 31–32, with optional retaining mechanism, 109. This offers the advantage of simplicity of design and slightly greater strength. A characteristic of this approach is that, at least in most handguns, the weapon will have to be field stripped to insert or remove the chamber block since it must be inserted from the rear of the chamber. This can be viewed as a disadvantage since it is less convenient, but can also be considered to be an advantage by offering greater security due to the fact that the chamber block would be difficult for a store customer to remove without being observed. Being one piece, the solid design does not need a retaining mechanism, but one can be used, primarily to hold it in position relative to the barrel.

FIG. 32 illustrates a variation on the chamber block of FIG. 31 wherein a collar, 166, is retained to the block by a cable tie or similar fastener. If the collar is the same diameter as or smaller than the outer diameter of the barrel, the action can still be operated and the weapon can still be stripped. Where the collar has increased diameter, it will also block the slide from moving forward, which on some weapons will prevent the weapon from being stripped which may be desirable. Alternatively the collar could be retained by threads, lugs, cams or similar either alone or in combination with a retaining mechanism such as a cable tie.

Materials

A variety of materials are applicable to the present invention including plastics and metals. Preferably, the material will be softer than that of the barrel and chamber so that the block does not scratch or mar the chamber or barrel, and especially not the chamber lip where it meets the barrel or the rifling in the barrel.

Brass or aluminum are good choices for those designs where no flexing of the block itself is required, such as those using a separate cable tie.

Various types of plastic have also been found to perform well. Acetal and nylon work well where only a slight amount of flex is desired and polypropylene works for those versions where a high degree of flex or slight compressibility is desired. Other plastics are clearly applicable and their selection would be straight forward based on the strength, flexibility and other characteristics desired in the end product. Machining, molding, and possibly even extrusion are candidate processes for forming the parts of the device.

Alternative Embodiments

The following discussion presents alternative embodiments which offer various advantages in structure or functions without departing from the principles of the invention.

Preferably, the rear edge of the chamber portion of the chamber block is designed such that it does not engage the ejector of the weapon, allowing the action to be operated. If desired, the chamber portion could be designed with the same lip, or other feature, of the original casing which engages the ejector. In this way, the slide would be locked closed by the ejector engaging the chamber block. Although relatively easy to bypass, this feature could provide a slight increase in tamper resistance.

Figure 33:
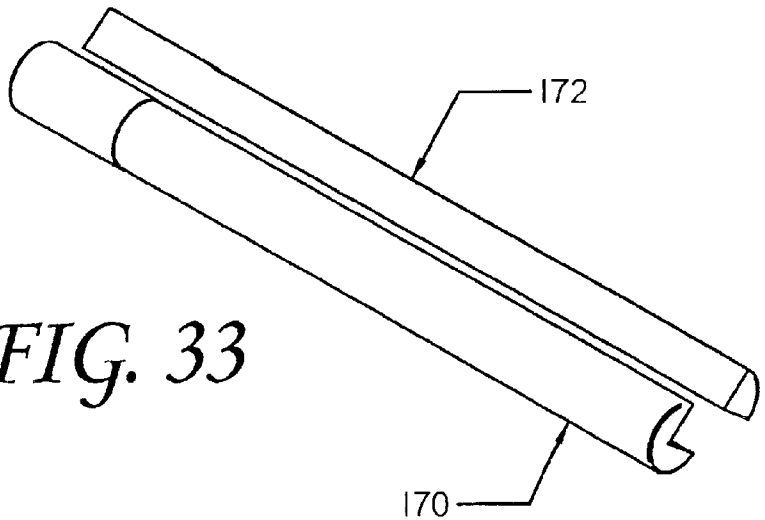
FIG. 33 illustrates an alternative asymmetric configuration of the segments.

Those embodiments which utilize a two-part split, such as FIGS. 3–13 may also be asymmetric for the entire length, such as 170 and 172 FIG. 33, especially where made from a material which is at least somewhat flexible or compressible. The larger part can be inserted first, compressing or flexing slightly to fit within the barrel. The smaller part can then be inserted, forcing apart the edges of the first part, resulting in a close fit. Of course, where the block is inserted from the chamber end, the material could be rigid.

The chamber block could incorporate an integral cutter for cutting the cable tie. The preferred form is a rotary cutter arranged so that the tie is cut when the cutter is turned. This is most easily achieved with a two-part barrel end where one piece holds the cutter and the other retains the cable tie in position against the force of the cutter. By using the barrel end, access to the two parts is facilitated. Preferably the part closest the barrel will be designed to be gripped by a wrench of some type while the furthest part can be gripped by hand or by a wrench.

Figure 34:
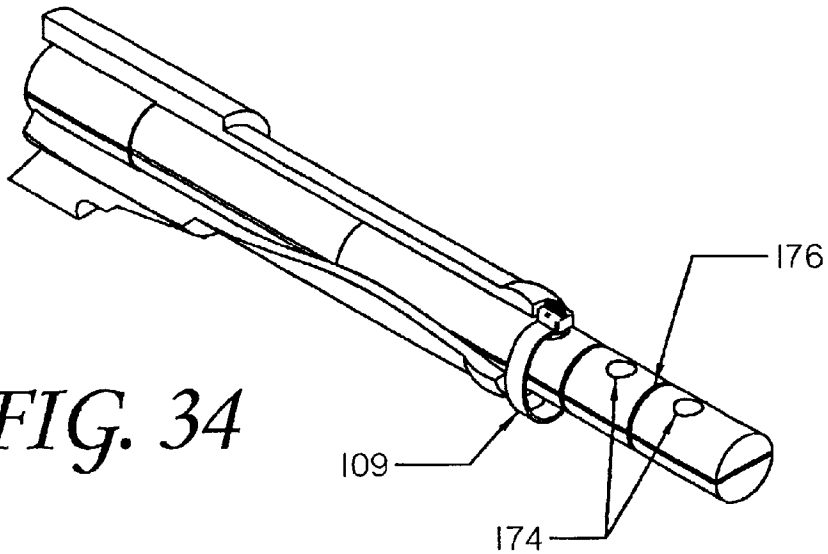
FIG. 34 illustrates an alternative embodiment with multiple holes and score lines for length adaptability.
Figure 35:
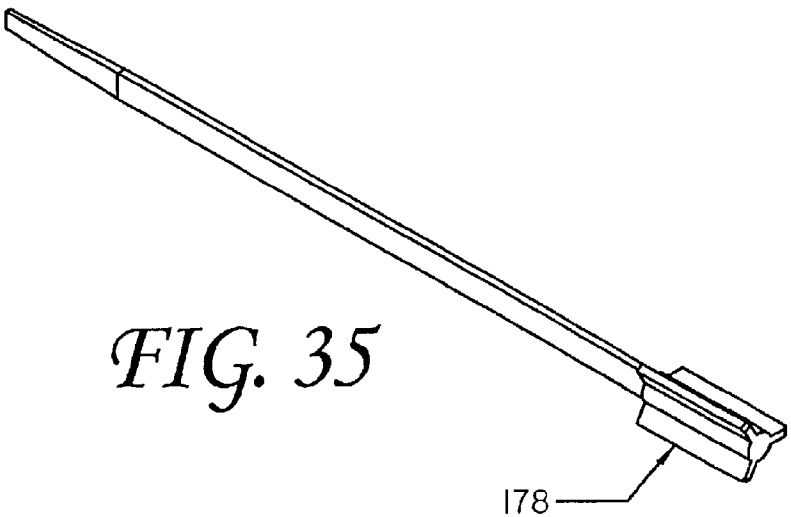
FIG. 35 illustrates a candidate non-circular chamber portion.

While the inventive chamber block is preferably manufactured in discrete lengths to match the barrel with which it will be used, it may alternatively be made to match the longest desired length and then scribed with grooves, 176 in FIG. 34, at intervals so that the segments can be cut or snapped off to shorten them to match shorter barrels. Where holes are used for the retaining mechanism, multiple holes, 174, may be provided in combination with the grooves.

While the preferred form of the invention has been disclosed above, alternative methods of practicing the invention are readily apparent to the skilled practitioner. The above description of the preferred embodiment is intended to be illustrative only and not to limit the scope of the invention.

I claim:

1. A chamber block for a weapon having a barrel and chamber, said chamber block comprising two segments, said segments having a common longitudinal axis, each of said segments comprising:

(a) a chamber portion adapted so that when said chamber portions of said segments are aligned they can be received within the weapon chamber but are unable to enter the bore of the barrel;

b) a barrel portion adapted so that when said barrel portions of said segments are aligned they can be received within the bore of the barrel; and (c) a reduced radius portion, connecting said chamber portion and said barrel portion, having a sufficiently reduced radius that when said reduced radius portion of one of said segments is positioned immediately adjacent to and substantially aligned with said chamber portion of the other of said segments, in a plane orthogonal to said longitudinal axis, said aligned portions can enter the bore of the barrel.

2. The chamber block of claim 1 further comprising a retaining mechanism adapted to interconnect said segments.

3. The chamber block of claim 1 wherein at least one of said segments defines a hole adapted to receive a cable for securing said chamber block to a fixture.

4. The chamber block of claim 1 wherein each of said segments has an outer surface and said reduced radius portion is formed by reducing the radius of said outer surface in the area of said reduced radius portion.

5. A chamber block for a weapon having a barrel and chamber, said chamber block comprising two segments, each of said segments comprising:

(a) a chamber portion adapted so that when said chamber portions of said segments are aligned they can be received within the weapon chamber but are unable to enter the bore of the barrel;

(b) a barrel portion adapted so that when said barrel portions of said segments are aligned they can be received within the bore of the barrel; and (c) a reduced radius portion, connecting said chamber portion and said barrel portion, having a sufficiently reduced radius that when said reduced radius portion of one of said segments is aligned with said chamber portion of the other of said segments said aligned portions can enter the bore of the barrel;

wherein each of said segments has an inner surface and said reduced radius portion is formed by relieving said inner surface in the area of said reduced radius portion.

6. The chamber block of claim 5 wherein said reduced radius portion is adapted to receive said barrel portion of the opposing segment whereby said segments can be substantially rigid.

7. A chamber block for a weapon having a barrel and chamber, said chamber block comprising two segments, each of said segments comprising:

(a) a chamber portion adapted so that when said chamber portions of said segments are aligned they can be received within the weapon chamber but are unable to enter the bore of the barrel;

(b) a barrel portion adapted so that when said barrel portions of said segments are aligned they can be received within the bore of the barrel; and (c) a reduced radius portion, connecting said chamber portion and said barrel portion, having a sufficiently reduced radius that when said reduced radius portion of one of said segments is aligned with said chamber portion of the other of said segments said aligned portions can enter the bore of the barrel;

wherein each of said segments is identical to the others.

8. A chamber block for a weapon having a barrel and chamber, said chamber block comprising two segments, each of said segments comprising:

(a) a chamber portion adapted so that when said chamber portions of said segments are aligned they can be received within the weapon chamber but are unable to enter the bore of the barrel;

(b) a barrel portion adapted so that when said barrel portions of said segments are aligned they can be received within the bore of the barrel; and (a) a reduced radius portion, connecting said chamber portion and said barrel portion, having a sufficiently reduced radius that when said reduced radius portion of one of said segments is aligned with said chamber portion of the other of said segments said aligned portions can enter the bore of the barrel;

wherein said segments are asymmetric when viewed from an end.

* * * * *